US006957607B2

(12) United States Patent
Biagiotti

(10) Patent No.: US 6,957,607 B2
(45) Date of Patent: Oct. 25, 2005

(54) DEVICE AND METHOD FOR CLEANING A SURFACE OF A ROTATING CYLINDER, SUCH AS A PLATE CYLINDER OF A PRINTING PRESS OR OTHER

(75) Inventor: Guglielmo Biagiotti, Lucca (IT)

(73) Assignee: Fabio Perini, S.p.A., Lucca (IT)

( * ) Notice: Subject to any disclaimer, the term of this patent is extended or adjusted under 35 U.S.C. 154(b) by 0 days.

(21) Appl. No.: 10/169,802

(22) PCT Filed: Jan. 24, 2001

(86) PCT No.: PCT/IT01/00033

§ 371 (c)(1),
(2), (4) Date: Jul. 9, 2002

(87) PCT Pub. No.: WO01/54909

PCT Pub. Date: Aug. 2, 2001

(65) Prior Publication Data

US 2002/0189474 A1 Dec. 19, 2002

(30) Foreign Application Priority Data

Jan. 28, 2000 (IT) ..... FI2000A0015

(51) Int. Cl.[7] ..... B41F 35/00
(52) U.S. Cl. ..... 101/424; 101/425

(58) Field of Search ..... 101/423–425, 101/416.1, 483, 487

(56) References Cited

U.S. PATENT DOCUMENTS

| | | | | |
|---|---|---|---|---|
| 5,438,923 | A * | 8/1995 | Schoeps | 101/147 |
| 5,452,657 | A * | 9/1995 | Kurz | 101/216 |
| 5,603,775 | A * | 2/1997 | Sjoberg | 134/21 |
| 5,644,986 | A * | 7/1997 | Gydesen | 101/424 |
| 5,732,631 | A * | 3/1998 | Walther et al. | 101/424 |
| 6,457,335 | B1 * | 10/2002 | Fleissner | 68/19.1 |

FOREIGN PATENT DOCUMENTS

| | | |
|---|---|---|
| DE | 196 03 455 A1 | 8/1997 |
| JP | 63-4947 | 1/1988 |
| WO | WO 94/12349 A1 | 6/1994 |
| WO | WO 95/01876 A1 | 1/1995 |
| WO | WO 97/00173 A1 | 1/1997 |

* cited by examiner

*Primary Examiner*—Anthony H. Nguyen
(74) *Attorney, Agent, or Firm*—Breiner & Breiner, L.L.C.

(57) ABSTRACT

The device comprises a suction chamber (41) having a mouth facing toward the cylinder and a nozzle (44) which is associated with the suction chamber and by which a jet of a cleaning liquid is generated. At least a first drying chamber (45, 47) is also provided, associated with said suction chamber (41) and connected to a suction pipe (43).

17 Claims, 3 Drawing Sheets

DEVICE AND METHOD FOR CLEANING A SURFACE OF A ROTATING CYLINDER, SUCH AS A PLATE CYLINDER OF A PRINTING PRESS OR OTHER

TECHNICAL FIELD

The present invention relates to a device for cleaning, in other words washing, a surface of a rotating cylinder, for example the surface of a plate cylinder of a printing press, such as a flexographic press, an embossing roller of an embossing and lamination assembly, or other.

More specifically, the invention relates to a device of the type comprising a suction chamber with a mouth facing toward the cylinder and a nozzle which is associated with the suction chamber and by which a jet of cleaning liquid is projected toward the surface of the rotating cylinder.

The invention also relates to a printing press employing a device of the abovementioned type, and to a method for cleaning a rotating cylinder.

STATE OF THE ART

In various situations it becomes necessary to clean a cylinder used for the transfer of a liquid, for example an ink, from one point to another in a machine. A requirement of this type arises in flexographic presses, where a plate cylinder receives the ink from a screen cylinder and transfers it onto the substrate to be printed. The plate cylinder has to be regularly subjected to cleaning of its incised surface to prevent the build-up of residues that may adversely influence the print quality.

Various devices and various methods have been studied with a view to solving the problem of cleaning the plate cylinder of a printing press without the need to remove the cylinder.

WO-A-9700173 discloses a system in which a device is mounted on a carriage moveable parallel to the axis of the plate cylinder, said device comprising a nozzle which sprays water or another washing liquid toward the surface of the plate cylinder. The nozzle is seated within a suction chamber having an aperture facing toward the surface of the cylinder to be washed. In this manner, the jet of washing liquid strikes a portion of the surface of the plate cylinder, and, by means of the vacuum generated in the suction chamber, the washing liquid, the ink residues and any residues forming on the surface of the plate cylinder are removed.

WO-A-9412349 discloses a cleaning system of the abovementioned type in which the suction chamber, within which is positioned the nozzle that generates the washing liquid, is surrounded by a hollow ring by means of which a flow of air under pressure is generated toward the interior of the suction chamber.

WO-A-9501876 discloses a system in which the washing head of the plate cylinder possesses two chambers side by side. A washing fluid, for example a liquid, a gas or a mixture of liquid and gas, is fed into the first chamber. A subatmospheric pressure is generated by suction in the adjacent chamber. This chamber is located with its mouth above the region in which the jets of fluid under pressure act against the plate cylinder, in order to remove by suction the-liquid and any residues detached from the surface of the cylinder.

In all these devices, the washing head gradually follows an axial development of the cylinder to be cleaned and performs the cleaning by annular regions, or more precisely in accordance with a helical travel, of the entire surface of the cylinder. The disadvantage of these devices resides in the fact that the removal of the washing liquid is not sufficiently effective, so that the printed product, during washing, undergoes a deterioration in quality and may even become weakened to the point of breaking, especially when it is produced from absorbent paper. It is additionally necessary to slow the speed of rotation of the plate cylinder, in order to increase the drying time.

JP-634947 discloses a cleaning system in which the surface of the plate cylinder is subjected to a jet of air under pressure. In this case again a suction system is provided, represented by a suction chamber having an aperture facing toward the surface of the plate cylinder and within which the blowing nozzle is positioned. In this case, no water or other washing liquid is used, and there are therefore no drying problems. However, the cleaning efficiency is poor because of the inadequacy of air as a washing fluid.

OBJECTS AND SUMMARY OF THE INVENTION

The object of the invention is to produce a cleaning device of the type mentioned initially which solves the problems and overcomes the limitations of the conventional devices.

In particular, an object of the invention is to produce a device which can more efficiently dry the cylinder.

Another object of the invention is to produce a cleaning method more efficient than the conventional methods.

Substantially, the device according to the invention provides that, apart from the suction chamber with the associated nozzle which generates the jet of washing liquid, at least one drying chamber is also provided, associated with the suction chamber and positioned downstream of the latter relative to the direction of advance of the surface of the cylinder to be washed. The drying chamber or chambers is or are connected to a suction pipe and may in practice be positioned side by side with the suction chamber.

In this manner, the washing liquid and the residues detached from the surface of the cylinder to be washed are removed by means of the suction chamber normally provided on the washing head. However, contrary to what happens in the conventional systems, each surface portion of the cylinder subjected to washing passes through not only the region of action of the suction chamber but also the drying chamber or chambers, where any residues of the washing liquid are efficiently removed, leaving the surface of the cylinder completely dried and therefore in optimum condition to receive a new supply of ink or other liquid to be transferred, or to perform the process for which it is intended, for example an embossing process, without disadvantages arising from the presence of residues of washing liquid.

When the invention is used on a printing press for the cleaning of the plate cylinder, this makes it possible for printing to continue, even at normal speed if desired, without adverse effects on, for example, the color intensity.

In practice it has been found particularly advantageous to position two drying chambers in succession downstream of the suction chamber and the associated nozzle.

Blowing nozzles may be associated with the drying chamber, or with each drying chamber, for the blowing-in of air under pressure against the surface of the cylinder to be dried. The blowing nozzles generate air flows of small cross section and high velocity which, impacting against the surface of the cylinder to be washed, detach therefrom any drops of water which may adhere there as a result of the surface adhesion forces. The puffs under pressure generated by the blowing nozzles are particularly effective in detaching residues of water contained in the cavities or incisions in the plate cylinder.

The device is therefore particularly suitable specifically for the cleaning of plate cylinders, of embossing cylinders, or of any cylinders whose surfaces exhibit incisions, depressions, cavities or other surface configurations suitable for retaining drops of liquid. These drops of washing liquid, unless appropriately removed, entail a temporary deterioration in print quality, in that they dilute the ink which the washed region of the plate cylinder will collect on its next rotation. Breaking of the printed material may also take place as a result of the excessive presence of liquid which is absorbed by said material. The device is also useful, for example, for cleaning embossing cylinders in embossing and/or lamination assemblies. In this case, the presence of water or other washing liquid on the embossing cylinder could result in damage to the material being embossed, which could absorb the liquid with a consequent reduction in its mechanical strength, hence resulting in breaking.

In practice, the blowing nozzles may advantageously be oriented so as to converge toward the central region of the drying chamber. This prevents the jets of air tending to disperse the residues of washing liquid outside the volume defined by the surface of the cylinder and by the drying chamber. More efficient removal of the residues of washing liquid is thus obtained.

Advantageously, the suction chamber which removes the washing liquid and the residues, and also the drying chamber or chambers, may be produced in a single appropriately shaped unit. This unit may possess a cylindrical surface of radius approximately corresponding to the radius of the cylinder to be washed. The aperture of the suction chamber and the aperture of the drying chamber or chambers are located at this cylindrical surface.

The aperture or apertures of the drying chamber or chambers facing toward the surface of the cylinder may have any suitable shape. According to a particularly advantageous embodiment, they have an elongate development in a direction orthogonal to the direction of the peripheral velocity of the cylinder. In this case, it is particularly advantageous to provide that the blowing nozzles positioned in the drying chamber or chambers are produced on one of the long sides of the respective aperture.

The washing head which comprises the nozzle for the projection of the jet of cleaning liquid, the suction chamber and the drying chamber or chambers is expediently carried—in a manner known per se—by a carriage or other moving apparatus associated with movement members which impart an alternating motion to the head parallel to the axial development of the cylinder which the device is to clean. In this manner, adjacent zones of a cylinder of substantial axial dimensions can be successively subjected to cleaning.

The invention also relates to a printing assembly comprising a rotating transfer cylinder for transferring ink to a substrate to be printed and a cleaning device for cleaning the rotating cylinder, having a suction chamber with a mouth facing toward the surface of the cylinder and side by side therewith and having a nozzle which is associated with the suction chamber and by which a jet of a cleaning liquid is projected. Characteristically, according to the invention, associated with the suction chamber is at least one drying chamber having an aperture adjacent to the mouth of the suction chamber, the drying chamber being positioned downstream of the suction chamber relative to the direction of rotation of the cylinder.

The printing assembly may be a printing assembly of a flexographic printing press or other assembly.

Further advantageous features of the cleaning device and of the printing assembly which employs it are indicated in the attached claims, and will be described in more detail below with reference to a possible example of embodiment of the invention.

The invention relates, finally, to a method for cleaning the surface of a rotating transfer cylinder for transferring a liquid, for example ink, in a printing press, in which a jet of a cleaning liquid is directed onto the surface of the cylinder, the cleaning liquid is removed by suction from the surface of the cylinder along with any residues removed by the liquid from the surface, creating a suction at the surface portion struck by the jet. Characteristically, according to the invention, each surface portion subjected to washing is subjected to at least one second pressure reduction, i.e. suction, to remove any residues of cleaning liquid from the surface.

According to an improved embodiment of the method according to the present invention, each surface region subjected to washing with the cleaning liquid is subjected, in the region in which it has been subjected to the second suction, to the action of jets of compressed air to detach any residues of liquid from the surface of the cylinder and permit their removal by suction by means of the second action of pressure reduction or suction applied to said surface.

In practice, in accordance with a particularly advantageous embodiment of the method according to the present invention, each portion of the cylinder to be washed is subjected, in addition to the first action of pressure reduction or suction to remove the cleaning liquid with the residues, to at least two further successive suction actions in order completely to remove the residues of liquid.

BRIEF DESCRIPTION OF THE DRAWING

The invention will be better understood by referring to the description and the attached drawing, which shows a practical and nonlimiting example of said invention. In the drawings.

DETAILED DESCRIPTION OF THE PREFERRED EMBODIMENT OF THE INVENTION

Figure 1:
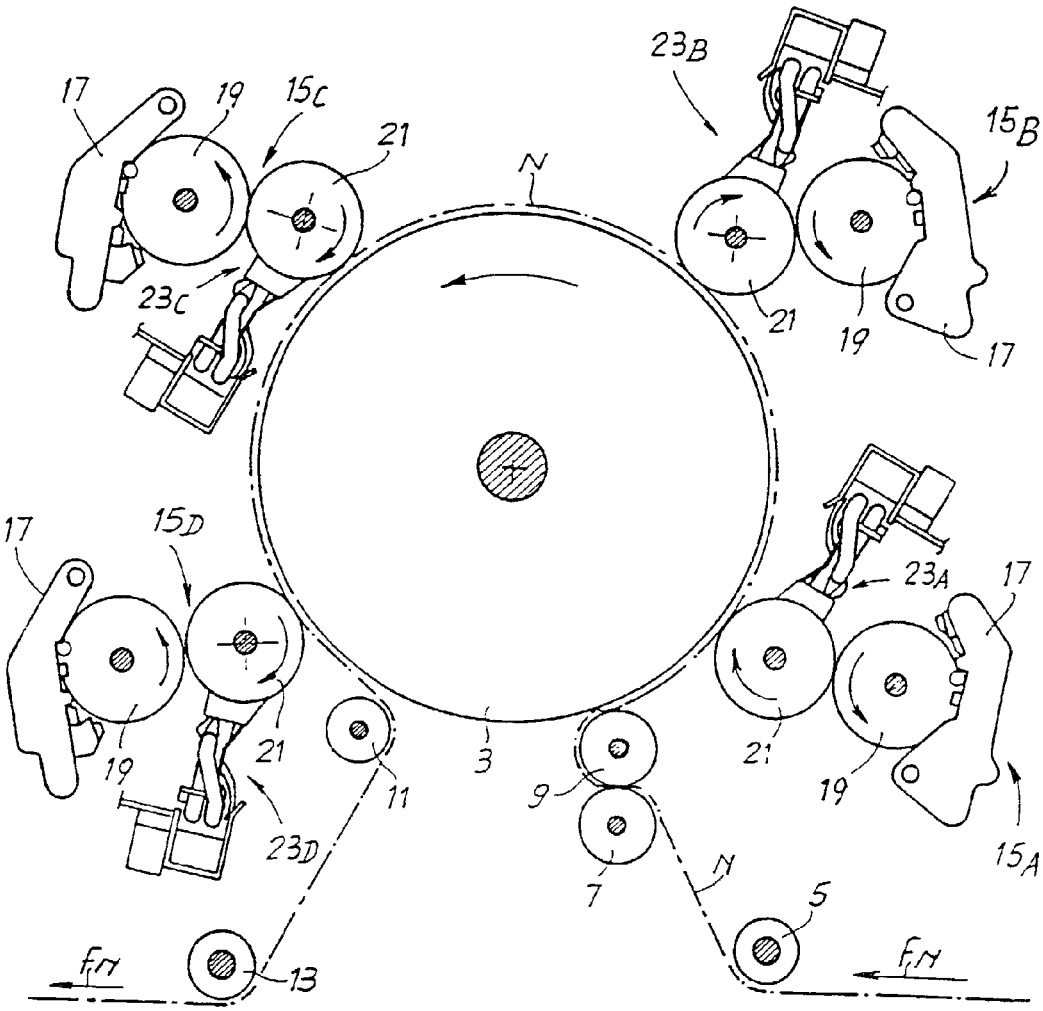
FIG. 1 shows a diagrammatic lateral view of a flexographic printing press with four printing assemblies each equipped with the device according to the invention.

As an example of application of the invention, FIG. 1 shows diagrammatically, in lateral view, a flexographic press having four printing assemblies, for the four basic colors, to each of which a washing device according to the invention is fitted.

More particularly, the press comprises a main drum 3 about which is passed the substrate to be printed, represented by a web material N, for example a strip of paper, plastic or the like. The direction of advance of the web material N is designated fN. Said material is guided around rollers 5, 7, 9, 11 and 13.

Arranged around the central drum 3 are four printing assemblies designated 15A–15D. Each printing assembly comprises an inker 17, a screen cylinder 19 and a plate cylinder 21. The ink, delivered by the inker 17 to the screen cylinder 19, is transferred from the screen cylinder 19 to the plate cylinder 21. To the latter is applied an etched plate bearing the mirror image of the image, print or whatever else is to be printed on the laminar web substrate N.

Associated with each plate cylinder 21 is a washing device, designated 23A, 23B, 23C and 23D for the individual printing assemblies 15A–15D. The four washing devices 23A–23D possess substantially the same structure and substantially differ only in their different orientations relative to the plate cylinder 21. Only one of the latter, therefore, will be described in detail below.

Figure 2:
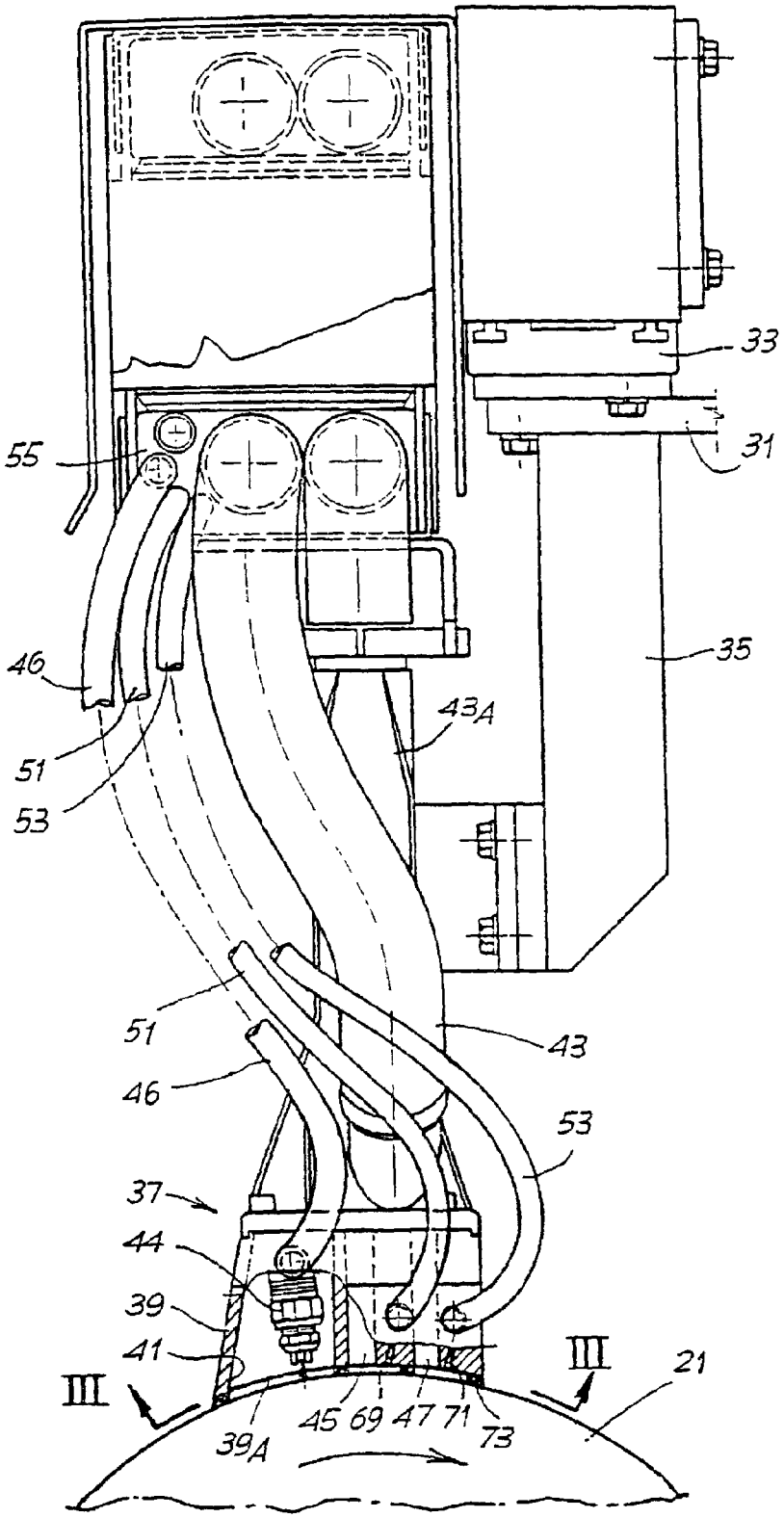
FIG. 2 shows, in lateral view and partial section, an enlargement of one of the washing devices.

FIG. 2 shows one of the washing devices, for example the device 23B. It comprises a carriage 31 which is moveable along a guide 33 extending parallel to the axis of the plate cylinder 21 and of the central drum 3. A motor drive (not shown) displaces the carriage 31 during operation along the guide 33 in a manner such that the entire cylindrical surface of the cylinder 21 is subjected to the washing action during the rotation of said cylinder.

Supported on the carriage 31 by means of a strap 35 is a washing head, generally designated 37. The latter comprises a unit 39 in which is made a first suction chamber 41 pneumatically linked to suction pipes 43 and 43A. Arranged within the suction chamber 41 is a nozzle 44 connected to a pipe 46 which feeds to the nozzle 44 a cleaning liquid, for example water or a detergent solution or other.

In the unit 39, in addition to the suction chamber 41, a first drying chamber 45 and a second drying chamber 47 are produced. The two drying chambers 45 and 47 are arranged in series and downstream of the suction chamber 41 relative to the direction of rotation of the cylinder 21.

Figure 3:
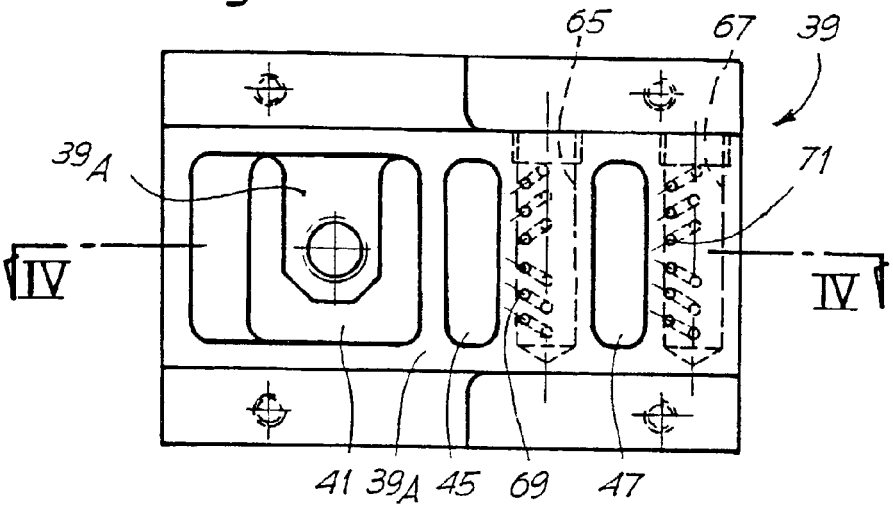
FIG. 3 shows a view along the line Ill—Ill of the piece from which the end portion of the suction chamber and the drying chambers are made.
Figure 4:
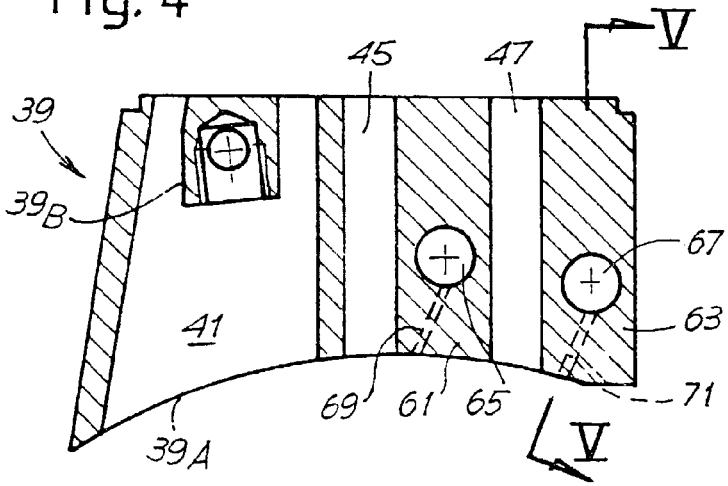
FIG. 4 shows a section along the line IV—IV in FIG. 3.

As can be seen in particular in FIG. 4, the unit 39 possesses a lower surface 39A facing toward the cylindrical surface of the plate cylinder 21, which has a substantially cylindrical shape of radius equal to or slightly greater than the radius of the plate cylinder 21. The apertures of the drying chambers 45 and 47 open onto the frontal cylindrical surface 39A of the unit 39. As can be seen in particular in the frontal view of FIG. 3, the drying chambers 45 and 47 have an elongate rectangular section with the short sides rounded. The major dimension of the drying chambers 45 and 47 is parallel to the axis of the plate cylinder 21. In FIG. 3, the shape of the suction chamber 41 can also be seen. In the latter, made from the same material as forms the unit 39, is provided a support 39B into which the nozzle 44 is screwed.

Each drying chamber 45, 47 is connected to the same suction pipes 43, 43A to which the suction chamber 41 is connected. In this manner, both the suction chamber 41 and the drying chambers 45, 47 are under subatmospheric pressure.

Figure 5:
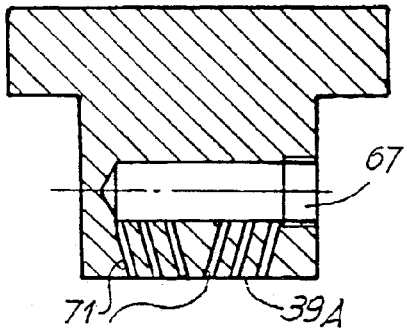
FIG. 5 shows a section along the line V—V in FIG. 4.

As can be seen in particular in FIGS. 3, 4 and 5 (which show the unit 39 of the head 37 without the relative accessories fitted thereto), with each drying chamber 45, 47 is associated a wall 61, 63 facing—relative to the associated drying chamber—in the opposite direction relative to the suction chamber 41. In the walls 61 and 63, transverse blind holes 65, 67 are made (see in particular FIG. 5), to which are connected lines 51 and 53 (FIG. 2). The lines 51, 53 are connected to a source of air under pressure, so that a superatmospheric pressure is created in the holes 65, 67. The holes 65 and 67 are connected to small holes 69 and 71 forming types of blowing nozzles which open into the thickness of the respective wall 61, 63 on the cylindrical surface 39A of the unit 39.

Thus, puffs of air under pressure are generated through the small holes 69 and 71 and directed against the cylindrical surface of the plate cylinder 21 and toward the central region of the head 37.

The lines 43, 46, 51 and 53 are brought together in a flexible channel 55, which permits the head 37 to perform the alternating movement along the axis of the plate cylinder 21, while the end of each line opposite the end connected to the head 37 is connected to a fixed point on the press.

As can be seen in FIG. 2, a gasket 73 is positioned on the cylindrical surface 39A, around the apertures of the drying chambers 45, 47 and around the suction chamber 41, reducing the gap between the cylindrical surface of the plate cylinder 21 and the cylindrical surface 39A of the unit 39.

The device briefly described above operates as follows.

During the normal functioning of the printing press at normal speed, the plate cylinder 21 of each printing assembly 15A–15D rotates at a peripheral speed equal to the speed at which the web substrate N to be printed is supplied, and transfers onto the latter the ink taken from the screen cylinder 19. From time to time, the surface of the plate cylinder 21 has to be washed in order to remove, especially from the incisions present in said plate cylinder 21, the residues that accumulate during operation, represented for example by powder, residues of the web substrate N to be printed, and the like.

When the washing or cleaning operation has to be carried out, the head 37 of the cleaning device is moved to one end of the respective plate cylinder 21 and is gradually displaced toward the opposite end at a speed such that the entire surface of the plate cylinder 21 is "brushed" by the head 37. During washing, a cleaning liquid, for example water or a suitable detergent, is sprayed through the nozzle 44. This jet projected onto the lateral surface portion of the plate cylinder 21 being in line with the mouth of the suction chamber 41 detaches the ink and any residues from the cylindrical surface of the plate cylinder 21.

The liquid and the residues are aspirated via the suction chamber 41 into the suction pipes 43, 43A. Each surface region or portion which passes in front of the suction chamber 41 then passes in front of the apertures of the drying chamber 45 and the drying chamber 47, arranged in series. In line with the drying chamber 45, the surface of the plate cylinder 21 is subjected to the action of the puffs of air under pressure orienting from the blowing nozzles formed by the small holes 69. These jets of air act on any drops of cleaning liquid that adhere to the surface of the plate cylinder 21 and/or in the cavities thereof, causing their detachment and, consequently, their aspiration through the drying chamber 45 which is under subatmospheric pressure as a result of the aspiration taking place through the suction pipes 43, 43A. A similar effect is produced by the blowing nozzles formed by the small holes 71 associated with the drying chamber 47.

In this way, each surface portion of the plate cylinder 21 is subjected to washing by means of the nozzle 44 and to the removal of residues, ink and some of the washing liquid via the suction chamber 41. Subsequently, the latter is subjected to a dual drying operation with forced removal of the residues of cleaning liquid via the drying chambers 45, 47 and the blowing nozzles 69, 71.

Tests have shown that, in this mode of operation, the surface of the plate cylinder 21 which emerges from the operating region of the head 37 is perfectly dried even when the plate cylinder continues to rotate at normal speed. This makes possible the complete washing of the plate cylinder during operation of the printing press, without the need to slow the press and without adverse effects on print quality.

It is understood that the drawing shows only a simplification, provided merely as a practical demonstration of the invention, said invention being capable of variation as to shapes and arrangements without thereby departing from the scope of the concept underlying said invention. The possible presence of reference numbers in the appended claims serves the purpose of facilitating reading of the claims with reference to the description and the drawing, and does not restrict the scope of the protection represented by the claims.

What is claimed is:

1. Device for washing a surface of a rotating cylinder, comprising a suction chamber with a mouth facing toward the cylinder; a nozzle in said suction chamber, said nozzle being constructed and arranged to generate a jet of a cleaning liquid; at least one first drying chamber adjacent to and downstream of said suction chamber, wherein said at least one first drying chamber is connected to a suction pipe; and at least one second drying chamber adjacent to and downstream of the at least one first drying chamber.

2. Device according to claim 1, wherein the suction chamber, said at least one first drying chamber, and said at least one second drying chamber are a single machined unit.

3. Device according to claim 2, wherein said single machined unit has a cylindrical surface in which the mouth of the suction chamber, an aperture of said at least one first drying chamber and an aperture of said at least one second drying chamber are present.

4. Device according to claim 1, further comprising at least one blowing nozzle, and wherein said at least one first drying chamber and said at least one second chamber are defined by respective walls which also define corresponding apertures, and said at least one blowing nozzle is present in said respective walls and is adjacent to respective apertures.

5. Device according to claim 4, wherein said at least one blowing nozzle is inclined toward an aperture of a respective drying chamber and suction chamber.

6. Device according to claim 4, wherein said aperture is elongated and said at least one blowing nozzle is positioned on one long side of the aperture.

7. A printing assembly comprising a rotating transfer cylinder for transferring ink from an ink applicator to a substrate to be printed;

a washing device for washing the cylinder, said washing device being positioned adjacent said cylinder and including a suction chamber with a mouth facing toward a surface of said cylinder, a nozzle in said suction chamber, said nozzle being constructed and arranged to generate a jet of a cleaning liquid onto said cylinder;

at least one first drying chamber having an aperture adjacent to the mouth of the suction chamber, the at least one first drying chamber being adjacent to and downstream of the suction chamber relative to a direction of rotation of the cylinder; and at least one second drying chamber adjacent to and downstream of the at least one first drying chamber.

8. Assembly according to claim 7, wherein the suction chamber, said at least one first drying chamber and said at least one second drying chamber are a single machined unit.

9. Assembly according to claim 8, wherein said single machined unit has a cylindrical surface in which the mouth of the suction chamber, an aperture of said at least one first drying chamber and an aperture of said at least one second drying chamber are present.

10. Assembly according to claim 7, further comprising at least one blowing nozzle, and wherein said at least one first drying chamber and said at least one second drying chamber are defined by respective walls which also define corresponding apertures, and said at least one blowing nozzle is present in said respective walls and open adjacent to respective apertures.

11. Assembly according to claim 10, wherein said at least one blowing nozzle is inclined toward an aperture of a respective drying chamber and the suction chamber.

12. Assembly according to claim 10, wherein said aperture is elongated and said at least one blowing nozzle is positioned on one long side of the respective aperture.

13. Device for washing a surface of a rotating cylinder comprising a suction chamber having a mouth facing toward the cylinder, said chamber including therein a first liquid blowing nozzle directed toward said cylinder so as to blow a cleaning liquid against the surface of the cylinder to detach dirt from said cylinder, said suction chamber being constructed and arranged to substantially remove said dirt from the surface of the cylinder by said suction chamber following detachment; and at least one drying chamber adjacent to and downstream of said suction chamber, said at least one drying chamber being connected to a suction pipe, and said at least one drying chamber having associated therewith at least one air blowing nozzle which generates a flow of air which operates in combination with said suction pipe to dry said surface of said cylinder.

14. Device according to claim 13, further comprising a plurality of said at least one blowing nozzle oriented so as to converge toward a central region of a respective drying chamber.

15. A printing assembly comprising a rotating transfer cylinder for transferring ink from an ink applicator to a substrate to be printed;

a washing device for washing the cylinder, said washing device being positioned adjacent said cylinder and including a suction chamber with a mouth facing toward a surface of said cylinder, a nozzle in said suction chamber, said nozzle being constructed and arranged to generate a jet of a cleaning liquid onto said cylinder;

at least one first drying chamber having an aperture adjacent to the mouth of the suction chamber, the at least one first drying chamber being adjacent to and downstream of the suction chamber relative to a direction of rotation of the cylinder; and at least one blowing nozzle which is associated with said at least one first drying chamber for providing air under pressure.

16. Assembly according to claim 15, further comprising a plurality of said at least one blowing nozzle oriented so as to converge toward a central region of a respective drying chamber.

17. Assembly according to claim 15, further comprising movement means for imparting an alternating motion to the device.

* * * * *